US009764882B2

(12) United States Patent
Simpson

(10) Patent No.: US 9,764,882 B2
(45) **Date of Patent: *Sep. 19, 2017**

(54) LOCKABLE CAP FOR A BOTTLE

(71) Applicant: Gatekeeper Innovation, Inc., Sacramento, CA (US)

(72) Inventor: Joseph C. Simpson, Lincoln, CA (US)

(73) Assignee: Gatekeeper Innovation, Inc., Sacramento, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/267,994

(22) Filed: Sep. 16, 2016

(65) Prior Publication Data

US 2017/0001777 A1 Jan. 5, 2017

Related U.S. Application Data

(60) Continuation of application No. 14/954,686, filed on Nov. 30, 2015, now Pat. No. 9,452,872, which is a continuation of application No. 13/585,742, filed on Aug. 14, 2012, now Pat. No. 9,199,773, which is a division of application No. 12/730,812, filed on Mar. 24, 2010, now Pat. No. 8,931,652, which is a continuation-in-part of application No. 12/573,799, filed on Oct. 5, 2009, now Pat. No. 8,662,330.

(60) Provisional application No. 61/239,597, filed on Sep. 3, 2009.

(51) Int. Cl.

| | |
|---|---|
| ***A61J 1/00*** | (2006.01) |
| ***B65D 55/14*** | (2006.01) |
| ***B65B 69/00*** | (2006.01) |
| ***B65D 50/06*** | (2006.01) |
| ***A61J 1/03*** | (2006.01) |

(52) U.S. Cl.

CPC ..... *B65D 55/145* (2013.01); *A61J 1/03* (2013.01); *B65B 69/00* (2013.01); *B65D 50/06* (2013.01); *Y10T 29/49826* (2015.01); *Y10T 70/554* (2015.04)

(58) Field of Classification Search

USPC .... 220/207, 201, 206, 219; 70/167, 168, 63, 70/165, 163, 312

See application file for complete search history.

(56) References Cited

U.S. PATENT DOCUMENTS

| | | | |
|---|---|---|---|
| 1,358,352 | A | 11/1920 | Wheelock |
| 2,009,216 | A | 7/1935 | Anibal |
| 3,151,756 | A | 10/1964 | Gruen |
| 3,426,932 | A | 2/1969 | Rouse |

(Continued)

FOREIGN PATENT DOCUMENTS

| | | | |
|---|---|---|---|
| CN | 2897860 | Y | 5/2007 |

OTHER PUBLICATIONS

First Office Action for CN 201080049649.2 (English and Chinese; dated Dec. 25, 2013 (15 pgs.).

(Continued)

*Primary Examiner* — Jeffrey Allen

(74) *Attorney, Agent, or Firm* — DLA Piper LLP (US)

(57) ABSTRACT

A lockable cap is a security feature for a medical prescription bottle. There is a dial locking mechanism that is attached to the cap and the dial locking mechanism and the cap can be attached or removed from the bottle only when the user has the correct combination on the dial lock. When the combination is incorrect, a mechanism including a dog plate within a cap portion, is disengaged and the inner cap cannot be removed from the bottle.

10 Claims, 12 Drawing Sheets

(56) References Cited

U.S. PATENT DOCUMENTS

| | | | |
|---|---|---|---|
| 3,445,021 | A | 5/1969 | Johnson |
| 3,684,117 | A | 8/1972 | Leopoldi et al. |
| 3,843,007 | A | 10/1974 | Meyer |
| 3,901,407 | A | 8/1975 | Mitchell et al. |
| 3,998,078 | A | 12/1976 | Detwiler |
| 4,366,687 | A | 1/1983 | Atkinson |
| 4,383,425 | A | 5/1983 | Orabona |
| 4,520,641 | A | 6/1985 | Bako |
| 4,794,768 | A | 1/1989 | Moser et al. |
| 4,829,796 | A | 5/1989 | Kim |
| 4,907,430 | A | 3/1990 | Hong |
| 4,984,698 | A | 1/1991 | Stuckey |
| 5,277,325 | A | 1/1994 | Yan |
| 5,911,764 | A | 6/1999 | Wei Kong |
| 6,688,146 | B2 | 2/2004 | Michels et al. |
| 6,786,346 | B1 | 9/2004 | Gurnard et al. |
| 6,793,081 | B1 | 9/2004 | Derman |
| 6,912,878 | B2 | 7/2005 | Belden, Jr. |
| 6,988,642 | B2 | 1/2006 | Gallo, Jr. et al. |
| 7,350,655 | B2 | 4/2008 | Belden, Jr. |
| 7,891,220 | B2 | 2/2011 | Yen |
| 8,020,415 | B2 | 9/2011 | Corbin |
| 8,931,652 | B2 | 1/2015 | Simpson |
| 8,938,999 | B2 | 1/2015 | Dahl |
| 8,944,263 | B1 | 2/2015 | Small |
| 2003/0089145 | A1 | 5/2003 | Michels et al. |
| 2004/0011098 | A1 | 1/2004 | Yang |
| 2006/0207958 | A1 | 9/2006 | Hamer |
| 2008/0098939 | A1 | 5/2008 | Kalous et al. |
| 2008/0302794 | A1 | 12/2008 | Wagner et al. |
| 2011/0049079 | A1 | 3/2011 | Simpson |
| 2011/0049080 | A1 | 3/2011 | Simpson |
| 2011/0079058 | A1 | 4/2011 | Nielsen |
| 2011/0210136 | A1 | 9/2011 | Wang |

OTHER PUBLICATIONS

PCT/US2010/047589 International Preliminary Report Search Report dated Mar. 6, 2012 (7 pages).

PCT International Search Report of PCT/US10/47589; dated Oct. 22, 2010 (2 pgs.).

PCT Written Opinion of PCT/US10/47589; dated Oct. 22, 2010 (6 pgs.).

Extended European Search Report of EP 10814459.3; dated Dec. 12, 2012 (4 pages).

SECTION B-B
SCALE 3 : 1

SECTION C-C
SCALE 3 : 1

SECTION D-D
SCALE 3 : 1

LOCKABLE CAP FOR A BOTTLE

RELATED PATENT APPLICATION/PRIORITY CLAIMS

This patent application is a continuation of and claims priority under 35 USC 120 to U.S. patent application Ser. No. 14/954,686 filed on Nov. 30, 2015 and entitled "Lockable Cap for a Bottle" (to be issued as U.S. Pat. No. 9,452,872 on Sep. 27, 2016) which in turn is a continuation of and claims priority under 35 USC 120 to U.S. patent application Ser. No. 13/585,742 filed on Aug. 14, 2014 and entitled "Lockable Cap for a Bottle" (issued as U.S. Pat. No. 9,199,773 on Dec. 1, 2015) which in turn is a divisional of and claims priority under 35 USC 120 to U.S. patent application Ser. No. 12/730,812 filed on Mar. 24, 2010 and entitled "Lockable Cap for a Bottle" (issued as U.S. Pat. No. 8,931,652 on Jan. 13, 2015) which in turn is a continuation in part of and claims priority under 35 USC 120 to U.S. patent application Ser. No. 12/573,799 filed on Oct. 5, 2009 and entitled "Lockable Cap for Medical Prescription Bottle" (issued as U.S. Pat. No. 8,662,330 on Mar. 4, 2014) which in turn claims the benefit under 35 USC 119(e) to U.S. Provisional Application Ser. No. 61/239,597 and entitled "Lockable Cap for Medical Prescription Bottle" filed on Sep. 3, 2009, which is incorporated herein fully by reference.

FIELD

The disclosure relates generally to a bottle and in particular to a medical prescription bottle.

BACKGROUND

There needs to be a security device to reduce unauthorized teenage, or other unauthorized user, prescription drug abuse. There is a problem with unauthorized users taking potentially harmful and addictive prescription medications from unmonitored medicine cabinets. People are unaware about how vulnerable their prescriptions can be when the only security device protecting them is a child proof cap. Thus, it is desirable to add a security measure to a bottle. With a more secure bottle, fewer unauthorized users will have access to potentially dangerous and addictive medications. The device prevents an unauthorized user from taking a few pills that could go unnoticed by the prescription drug holder. For example, the security device can be broken in order to gain access, but this action would be noticeable by the prescription drug holder, and therefore further security actions can be taken.

DETAILED DESCRIPTION OF ONE OR MORE EMBODIMENTS

The disclosure is particularly applicable to a prescription medical bottle and it is in this context that the disclosure will be described. It will be appreciated, however, that the device has greater utility since the device can be used with various other types of bottles or containers in which it is desirable to be able to securely lock the bottle/containers from unauthorized use.

Figure 1:
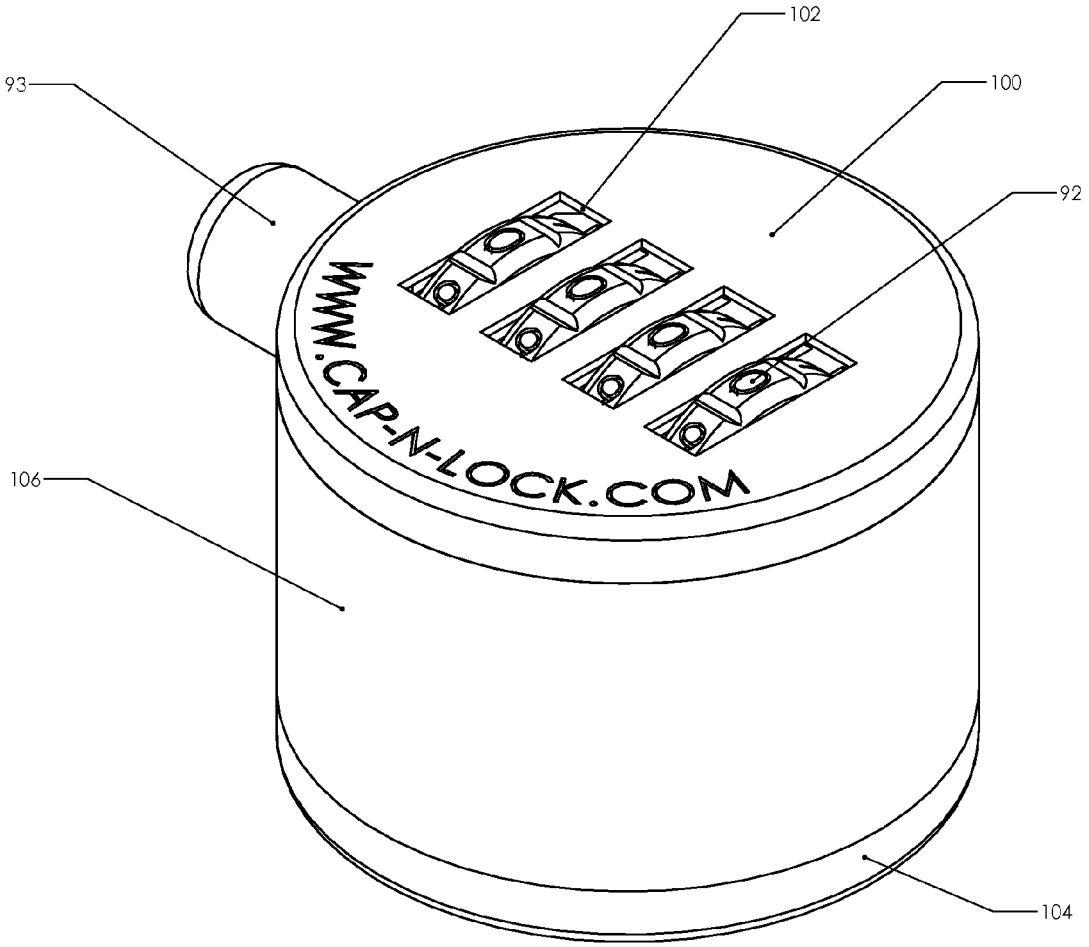
FIG. 1 is a perspective view of an embodiment of an assembled cap locking device.

FIG. 1 is a perspective view of an assembled cap locking device that include a housing cover 100. The device may have one or more numerical cogs 92 and the housing may have a corresponding number of one or more gaps 102 through which the cogs protrude as shown in FIG. 1. In one implementation, the device may have 4 cogs 92 and four gaps in the housing as shown in FIG. 1, but the device is not limited to any particular number of cogs/gaps. The device also may have an outer housing 106 that surrounds the internal elements of the device and a lower housing 104 that closes the bottom of the device opposite of the cogs. The device may also have a reset pin 93 that allows the user to reset the numerical combination to which the cogs must be turned (1234, for example in this implementation) by the user to open the device. The reset pin 92 does not need to be a specific shape as any element/pin inserted into the reset hole would work (as long as the system is unlocked).

Figure 2:
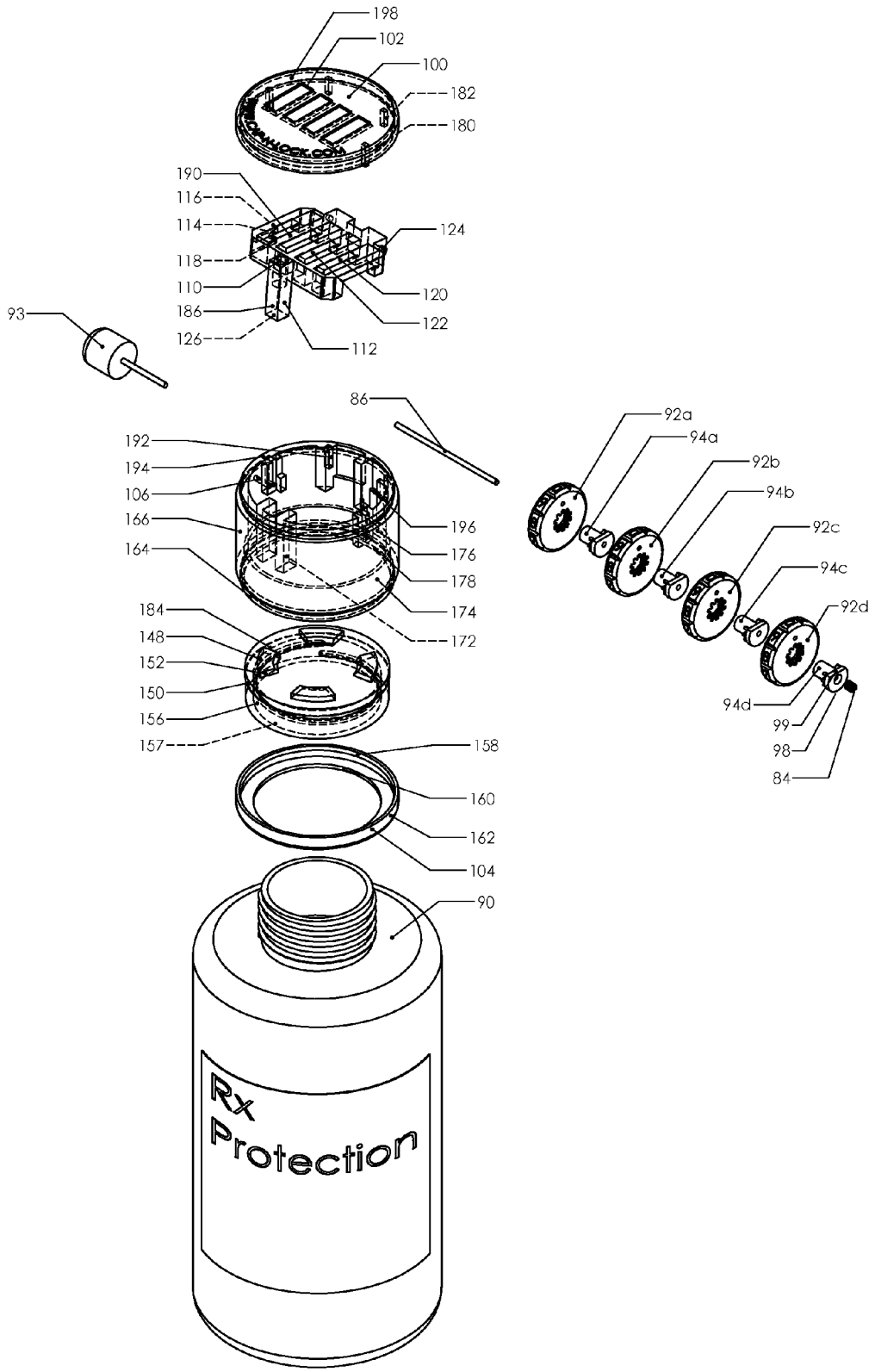
FIG. 2 is an exploded view of the internal parts of an embodiment of the cap locking device.

FIG. 2 is an exploded view of the cap locking device. As shown in FIG. 1, the device may have the one or more cogs 92 (cogs 92*a*, 92*b*, 92*c* and 92*d* in one implementation) and one or more cams 94 (cams 94*a*, 94*b*, 94*c*, and 94*d* in one implementation) that fit inside of one or more cogs. The cams and numeric cogs then slide onto a wheeled axel 86 and the assembled parts are placed into a set of slots 194 in the housing (the slots are shown in more detail in FIG. 7A) that support the cogs, cams and the wheeled axel in the housing. Once the cogs, cams and the wheeled axel are in the housing, a spring 84 holds the cams firmly against the numeric cogs. After the assembled cogs, cams and wheeled axel are in the housing, a lock plate 190 is placed on top. The lock plate has an extension 124 as shown in more detail in FIG. 3A that a slot 192 on each side of the housing (shown in FIGS. 2 and 7A) The positioning of slot 192 and extension 124 form a pivot point for the lock plate 190 and the housing 106. The lock plate 190 pivots depending on the positioning of the one or more cams 94, shown unlocked in FIG. 2 since the lock plate 190 would be positioned down when it is unlocked.

The cam 94*d* shows how the locking system works. In particular, when all the cams 94 are aligned with the flat surfaces facing upward with the faces 99 (as shown in FIG. 2), the system is unlocked. When even one cam is rotated so the round portion of the cam 98 is facing up, the lock plate 190 is held upward and the device is locked.

Once the cam assembly and locking plate are placed into the housing, the housing cover 100 is attached to the housing 106. The housing cover holds the components of the numeric cogs and the lock plate in place in the device. The numeric cogs 92 stick above the housing cover when the device is assembled (as shown in FIG. 1) so that a user can spin the cogs on their axel. The device has, below the housing cover when the device is assembled, a dog cap 184. The dog cap slips into the housing from the bottom and spins freely (when locked) within the housing. To hold the dog cap in the housing, a lower housing 158 is attached to the lower part of the housing 164. The dog cap is slightly smaller than the housing that contains it which allows it to spin freely (when locked) within the housing. When unlocked, a lock arm 126 of the lock plate 190 engages the gaps 152 in the teeth 148 of the dog cap 184 (shown in FIG. 2 and in more detail in FIG. 4A) allowing the user to put tension on the cap and remove the cap from the bottle to which the cap is attached. To attach the cap onto the bottle, the user twists an unlocked cap onto a bottle, twists tight, and then mixes up the numbers which lifts the lock plate and allows the dog cap to spin freely thus locking the cap and access to the contents of the bottle. This allows for a greater safety and security measure for the contents within any bottle or container 90 since unlocking the cap requires the numerical code as well as being able to push down the cap and remove it from the bottle.

Figure 3A:
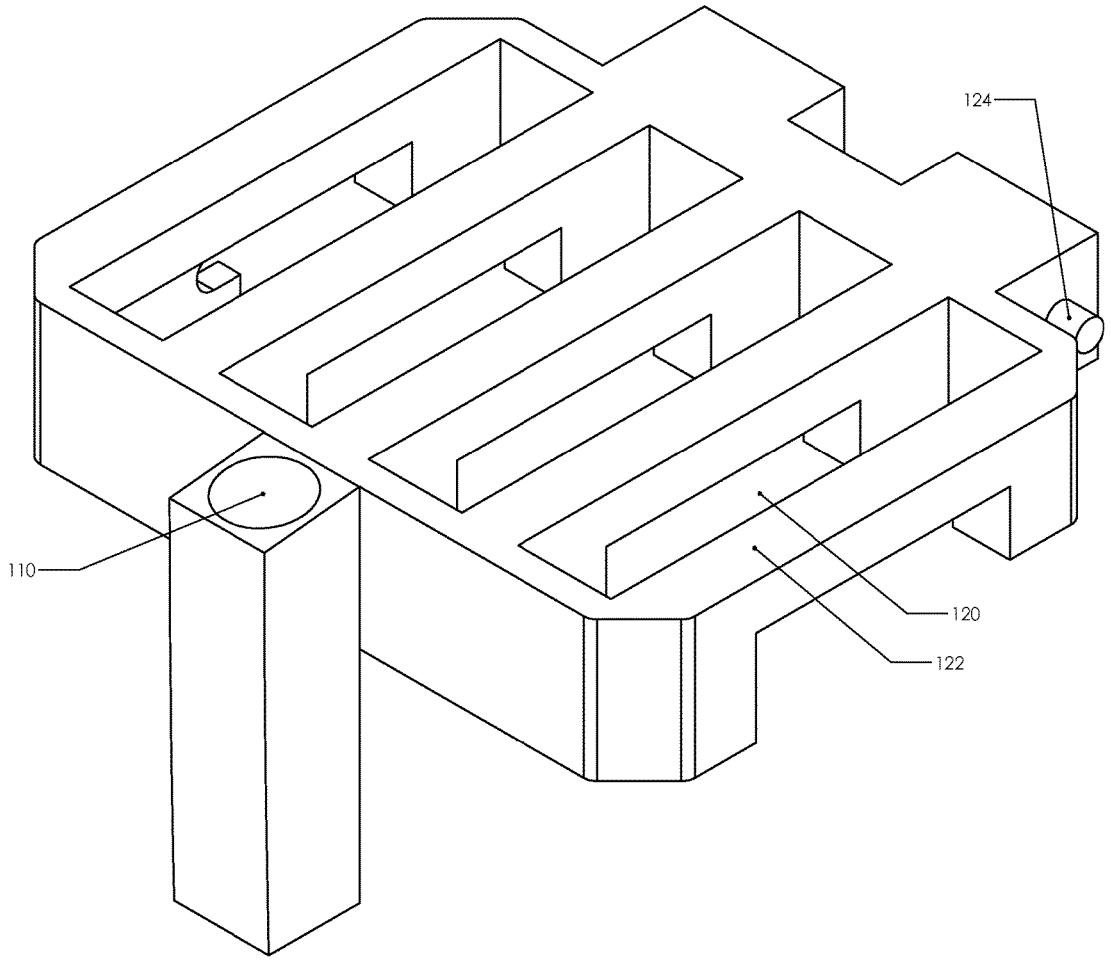
FIG. 3A is an isometric view of an embodiment of a lock plate that is part of the cap locking device.
Figure 3B:
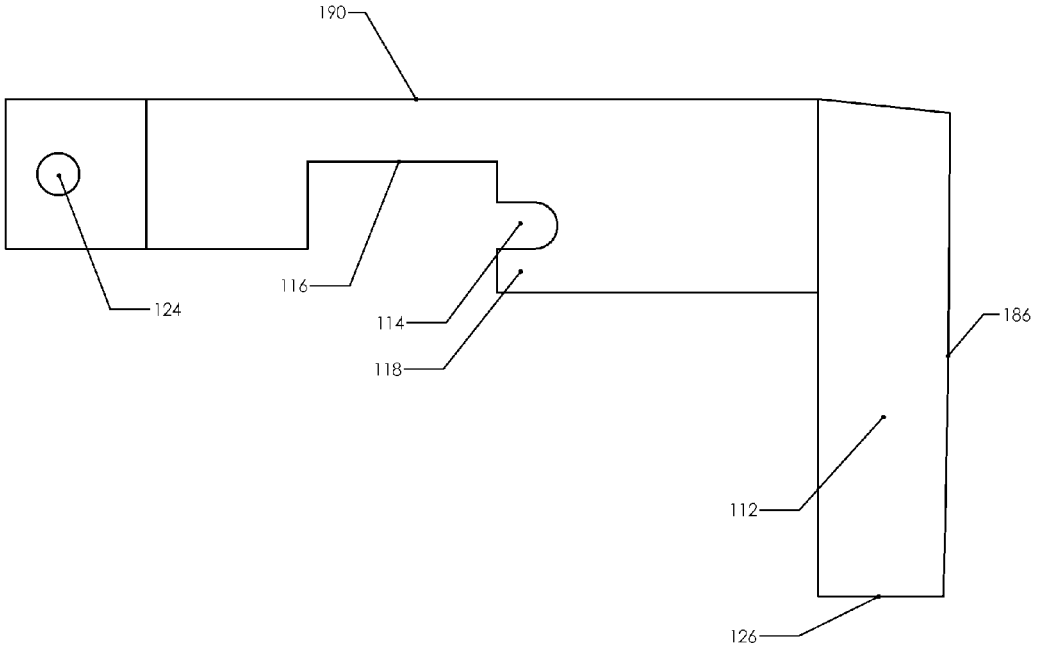
FIG. 3B is a side view of the lock plate.

FIG. 3A is an isometric view of a lock plate 190 of the cap locking device and FIG. 3B is a side view of the lock plate that was not shown in FIG. 3A. The lock plate 190 is the moving component of the locking device that engages and disengages from the dog cap 184 in order to lock and unlock the device. The lock plate 190 can have many different shapes and designs and an illustrative embodiment of the lock plate is shown in FIG. 3A. The embodiment of the lock plate 190 shown in FIG. 3A utilizes a lever-style system that pivots from the far end at the extension 124. The cams 94 shown in FIG. 2 are the components that move the lock plate 190 up or down. The cams 94 fit within the numeric cogs 92 and together they act as one turning unit. The numeric cogs fit through one or more gaps 120 of the lock plate. There can be any number of gaps in the lock plate depending on the desired amount of numbers in the combination. In the device embodiment shown and described, the lock plate 190 is positioned above the cams 94. The lock plate also could be positioned below the cams and the cams in the locked position would push down on a lock plate. In the embodiment shown, the cams push the lock plate up from the lower portion of the lock. The lock plate may have a resilient device 110, such as a spring, that fits into a hole 110 in the locking plate in order provide the necessary downward pressures needed to unlock the device. The cap locking device also allows downward pressures to be applied without the locking components being mechanically influenced to any substantial degree. This position has the advantage of eliminating the possibility of someone being able to push downward in order to "feel" the combination. Therefore the position of the locking plate acts as a tamper resisting element.

FIG. 3B shows how the cap locking device can and/or cannot be reset. The locking plate 190 has a reset access indent/outlet 114. This outlet 114 is only available when the system is unlocked (lock plate down). When the system is locked and the locking plate 190 is up, the reset access is blocked by arm 118 and the reset pin 93 cannot be inserted into the reset access outlet.

To reset the cap locking device, the device must be unlocked (lock plate down in one embodiment) and the user puts the reset pin 93 through the reset outlet 106 of the housing. The reset pin then passes through the reset indent/outlet 114, and comes in contact with the cam 94*a*. All the cams 94*a*, 94*b*, 94*c*, 94*d* are able to move slightly along the axel. The cams 94*a*, 94*b*, 94*c*, 94*d* are held against their corresponding numeric cog by the spring 84 which sits at opposing end of the axel 86. The reset pin pushes the cams which move together compressing the spring 84 at the far end. The slight offset of the cams from the numeric cogs forced by the reset pin and allowed by the compression of the spring 84 permits the numeric cogs to spin independent from the cams. When the numeric cogs spin independent from the cams the user can reset the system to a new combination. With the new combination aligned across the center of the cap the user releases the reset pin which causes the cams to slide back into place with the numeric cogs. The spring 84 causes the numeric cogs and cams to pair making them spin dependently with each other, thus allowing users to personalize the numbers. A user can only reset to a personal combination when the system is unlocked. The locking plate can be in two positions, up (locked) or down (unlocked). The locking plate 190 pivots from extension 124 and is pushed up or let down by the cams that push in four places directly at a position 116 when the cams are in the position without the flat surfaces being up. This pivot motion lifts or lowers a lock arm 112 and a lower portion of the lock arm 126 either engages or disengages the teeth of the dog cap FIG. 4A as described above.

In more detail, the cap locking device is based on an idea of a gear slipping device. In particular, when the cap is unlocked the locking plate 190 in FIG. 2 and FIG. 3A that sits on the cams 94*a-c* is rotated into the flat position. With this cam position 99 in FIG. 2, the lock plate is in the down position making the connection between the lock plate of FIG. 3B at 126 and the dog plate FIG. 5A at 150 for applying the cap and 152 for removing the cap.

Figure 4A:
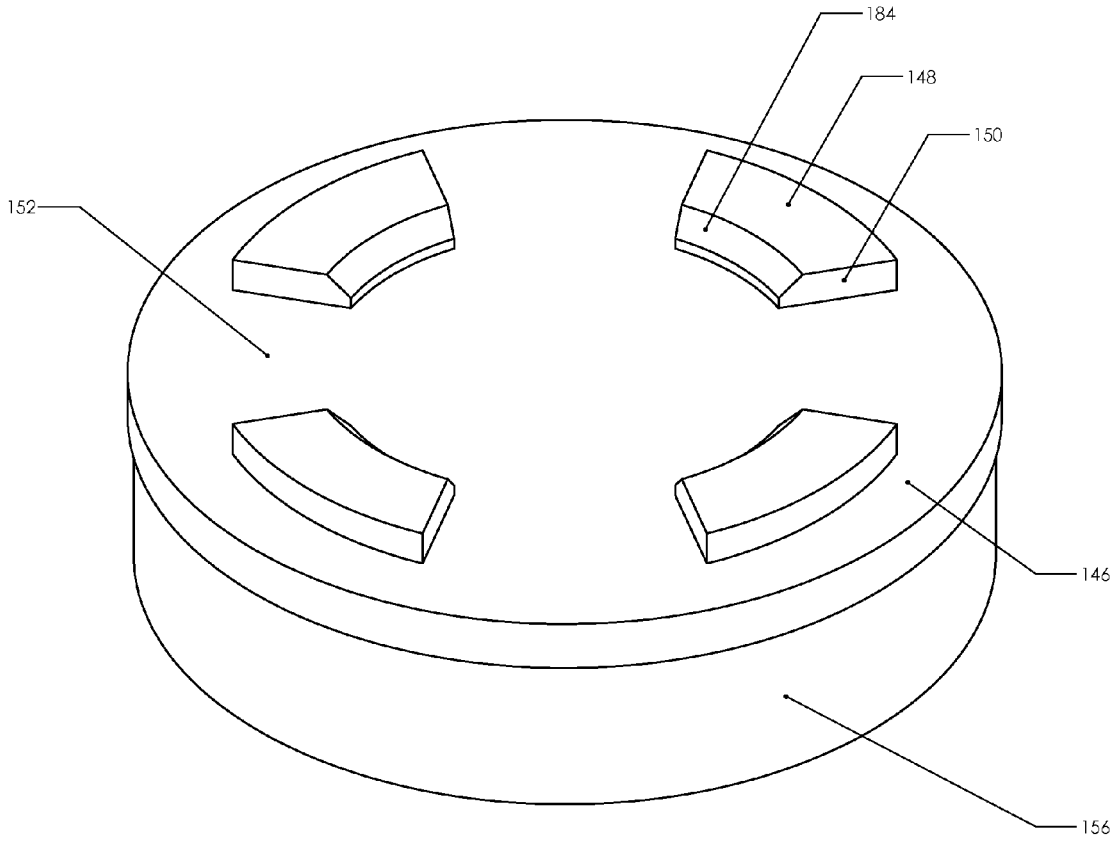
FIG. 4A is an isometric view of an embodiment of a dog cap of the cap locking device.
Figure 4B:
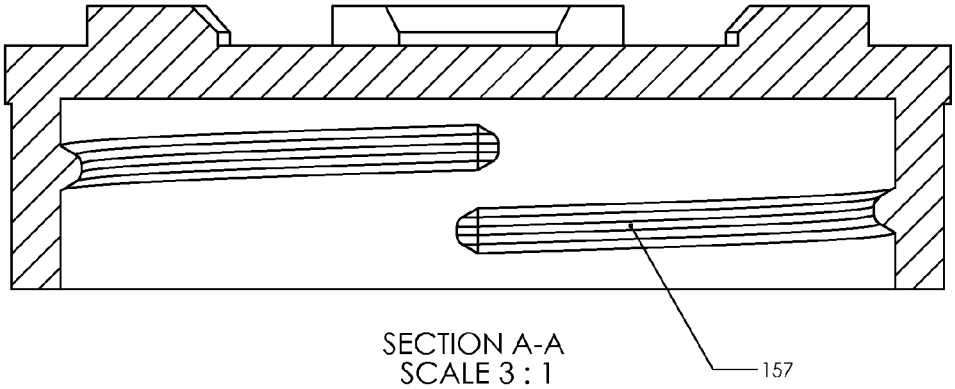
FIG. 4B is a side view of the dog cap.

FIG. 4A is an isometric view of a dog cap 184 of the cap locking device. This is a cap that can be made to any size to fit a variety of bottles and the disclosure is not limited to the cap shown in FIG. 4A. The dog cap 184 can spin freely within the cap locking device when it is locked. When unlocked, the lock arm 112 of the locking plate 190 shown in FIG. 3B hits one of the four gaps 152 in the teeth 148 of the dog cap. When unlocked, the lock arm 112 and in particular the bottom of the lock arm 126 can push against a surface 150 the teeth 148 and apply torque to the teeth 148 allowing the cap to be rotated and therefore removed. On an inner portion of each of the teeth there is an inlayed bevel 184, such as a forty five degree cut, that allows the numeric cogs to have slightly more space. The dog cap 184 is able to spin freely within the housing. The gap 146 from the teeth to edge of the cap makes the cap sit in the correct position in the housing wherein a counter-ridge 176 in the housing is shown in FIG. 7B. The side 156 of the dog cap 184 may be smooth to slip within the housing to keep friction to a minimum so a user cannot remove the cap when it is locked as the dog cap 184 will slip inside the housing unless the cap locking device is unlocked. FIG. 4B shows an example of a set of threads 157 within the dog cap 184 so that the assembled cap locking device can be screwed onto a bottle.

Figure 5A:
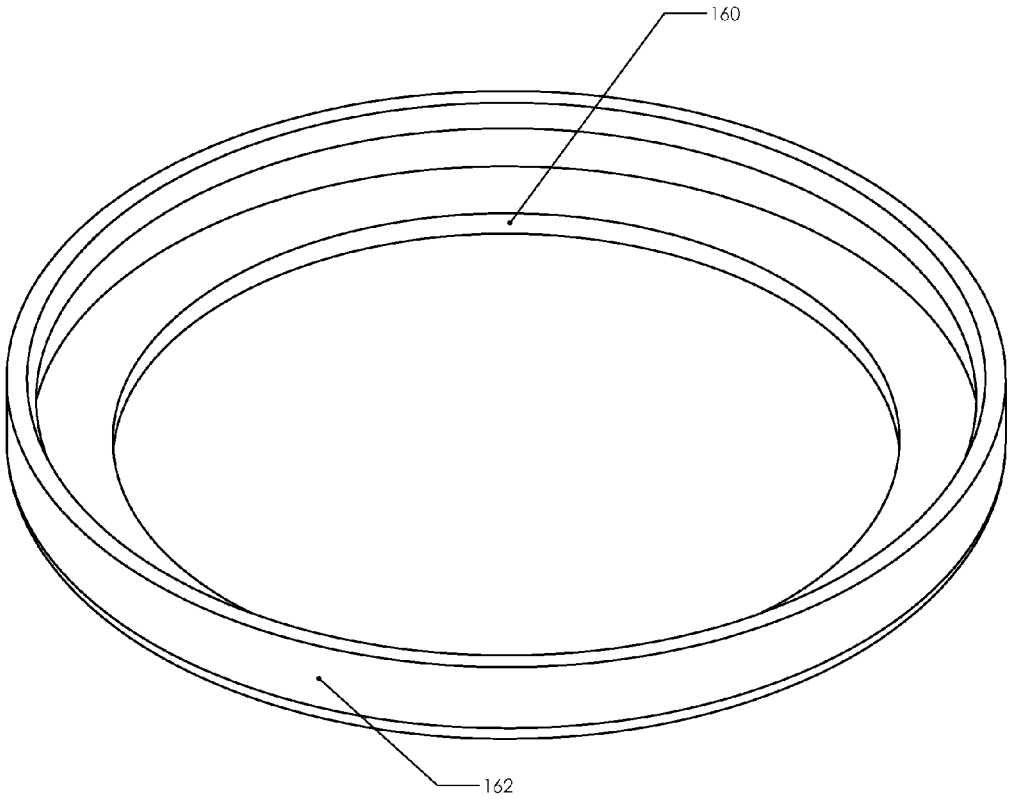
FIG. 5A is an isometric view of a housing base plate of the cap locking device.
Figure 5B:
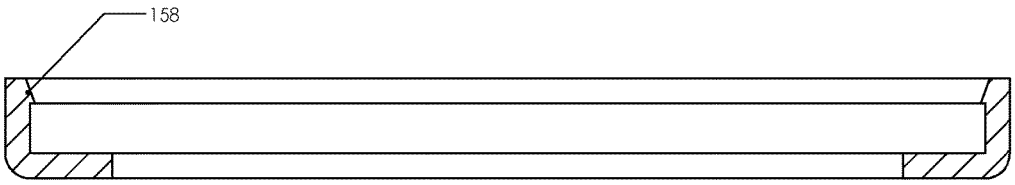
FIG. 5B is a side view of the housing base plate.

FIG. 5A shows a housing base plate 104 of the cap locking device. This piece holds the dog cap 184 within the housing. The housing base plate 104 may have a ridge 160 that is inward from an outer side 162 of the housing base plate 104. The ridge 160 extends inward in order to hold the dog cap 184 within the housing. FIG. 5B show how the housing base plate 104 is permanently attached to the housing. In particular, there may be a snap ridge 158 that circles the top of the entire housing base plate. The snap ridge 158 uses the small elasticity of plastic so that it can bend outward slightly when being applied. However, once it snaps into its counter part 178 shown in FIG. 7B, the snap ridge cannot be removed. The housing base plate 104 can also be permanently attached with a glue or plastic weld.

Figure 6A:
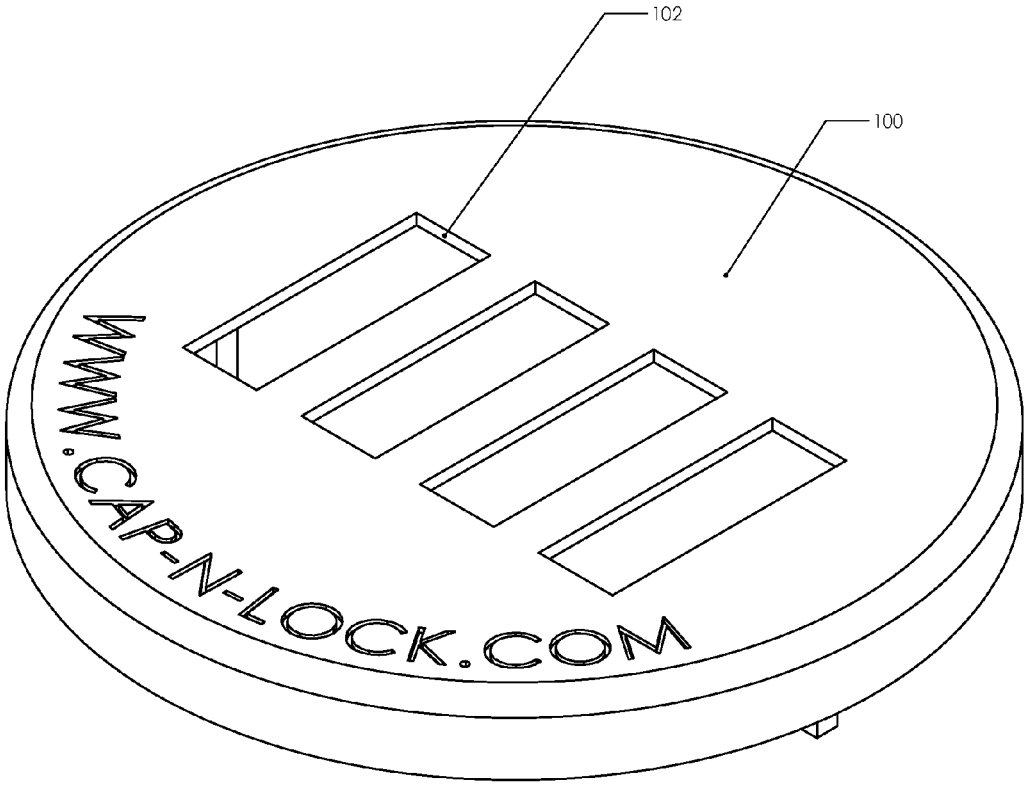
FIG. 6A is an isometric view of a housing cover of the cap locking device.
Figure 6B:
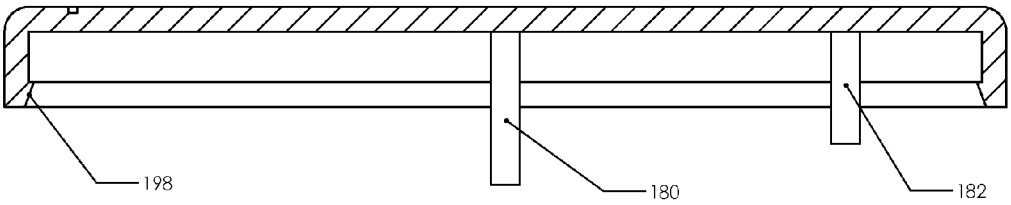
FIG. 6B is a side view of the housing cover.

FIG. 6A illustrates the housing cover 100 of the cap locking device. The housing cover 100 holds the interior components in place. The slots 102 for the numbers are designed to be as large as possible. The actual number of slots depends on the number of numerical cogs used in the particular implementation and the cap locking device can use one or more numerical cogs. A top surface 100 can have anything; this one has the example of WWW.CAP-N-LOCK.COM engraved into it. The engravings can be depressed or raised in order to get a variety of messages across to the user. The top surface also has the slots 102 and the slots may be positioned in the center of the housing cover so that the numeric cogs are also substantially positioned in the center of the housing cover. FIG. 6B is a side view of the housing cover 100. From this angle, a permanent snap feature 198 is visible. The snap feature 198 of the housing cover fits the corresponding slots 188 as shown in FIG. 7B. The extension 180 that holds the numeric cog and cam axel is shown, and the extension 182 that holds the lock plate is shown. Similar to the housing base plate the housing cover can permanently snap into place using ridges but, this piece can also be attached with glue or a plastic weld.

Figure 7A:
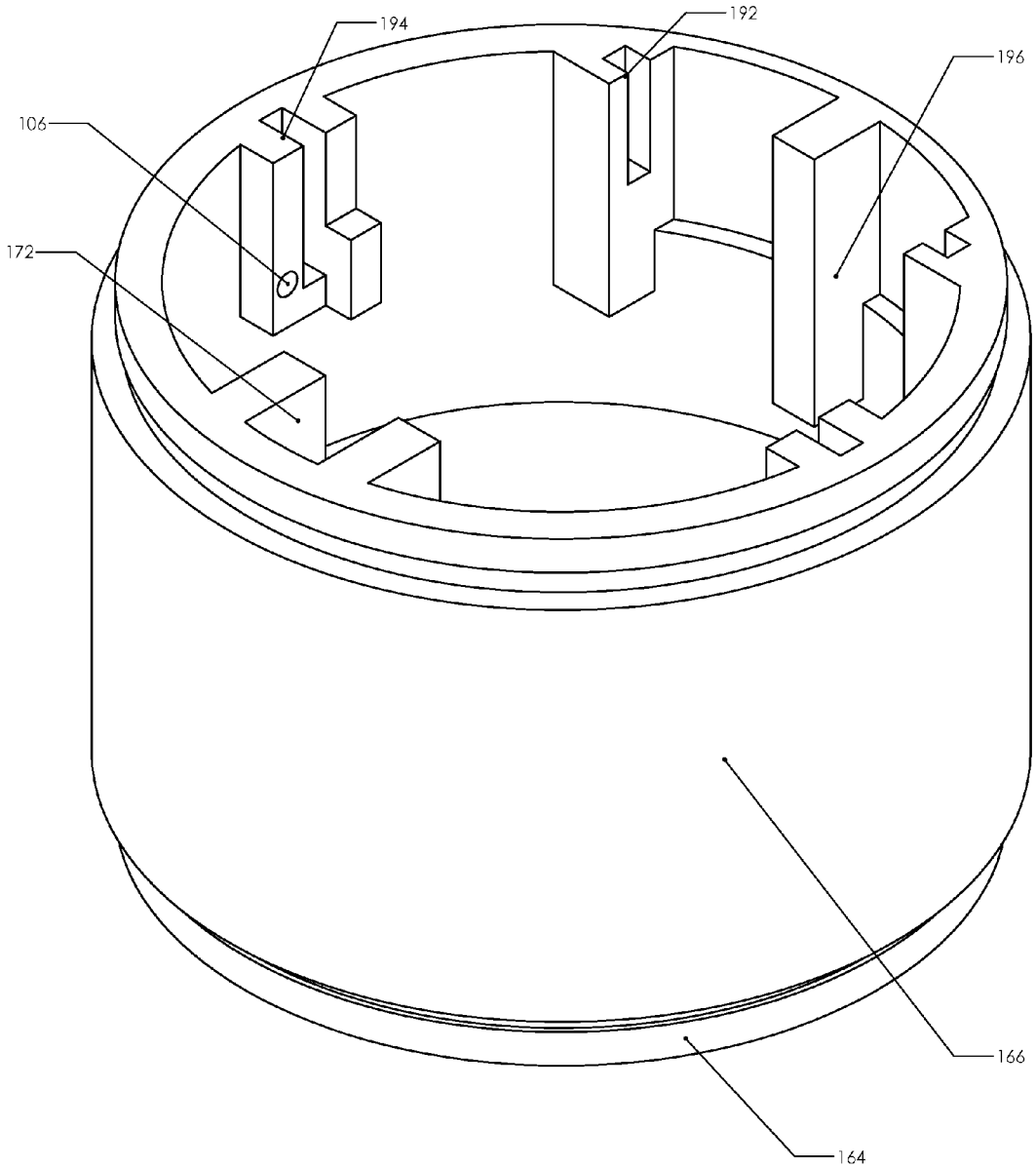
FIG. 7A is an isometric view of a housing of the cap locking device.
Figure 7B:
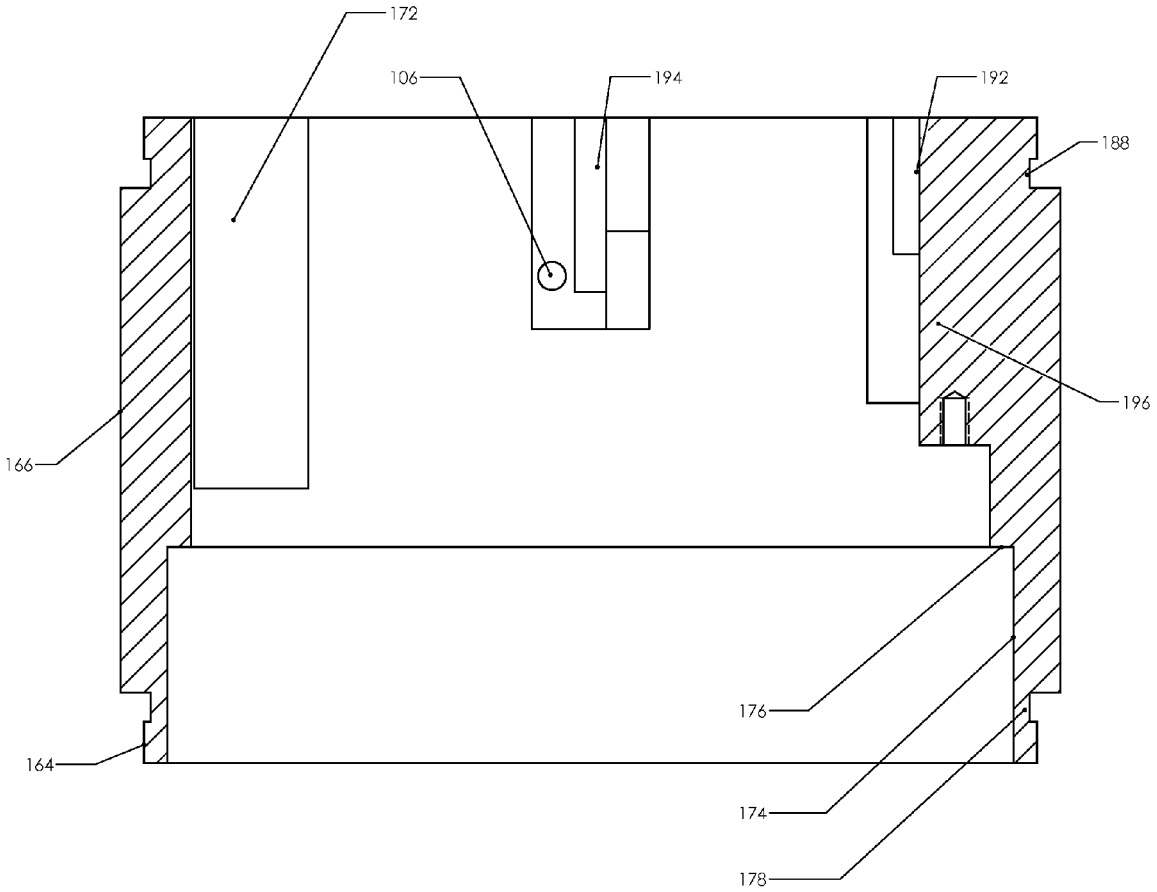
FIG. 7B is a side view of the housing.

FIG. 7A is an upper isometric view of a housing of the cap locking device. The housing holds all the inner components together. In particular, the numeric cogs and cam axel slides into place from the top, resting in the pair of cut out groves 194. This grove holds the axel in place. The locking plate 190 shown in FIG. 3A has extensions 124 that fit into the slots 192. This connection is the pivot point for the locking plate as described above. The lock arm 112 of FIG. 3B fits into the lock arm brace 172. When assembled, there is a gap between the outer edge of the lock arm brace and the end 186 of the lock arm which allows for the pivoting movement of the locking plate without this component binding within the lock arm brace 172. The housing 106 may also have a cut out depression 196 so that there is room for the back of the locking plate 190 to pivot without binding. A side 166 of the housing is smooth in one implementation but it could have a lined or soft grip. There is one entry point 166 on the exterior of the housing which is a reset hole 106 of FIG. 7A and FIG. 7B. The reset hole is the access point to reset the combination of the cap. The locking cap device can only be reset when the system is unlocked. In order to reset the cap when it is unlocked, a user inserts a resetting pin 93 or any straight small rod such as a straightened paper clip through the housing reset hole 106. The reset pin then passes through the lock plate reset outlet 114 of FIG. 3B of the locking plate and comes into contact with the cam 94*a*. When the user puts a small amount of force behind the pin, the cams 94*a*, 94*b*, 94*c*, 94*d* compress a tension actuator 84 which causes the cams 94*a*, 94*b*, 94*c*, and 94*d* to slide off their connection with their congruent numeric cogs 92*a*, 92*b*, 92*c*, and 92*d*. The numeric cogs are held in place by the slots 120 in the lock plate of FIG. 3A and the slots 102 in the housing cover of FIG. 5B. Because the numeric cogs are held in place when the cams 94*a-d* are offset, then the numeric cogs can spin independently from the cams allowing the combination to be reset. When the pin is released, the cams slide back into their congruent numeric cog which allows a user to reset the system to a new personal combination. The device can only be reset when it is unlocked. When locked, the reset access outlet is blocked by 118 of FIG. 3B, and a user cannot offset the cams 94*a*, 94*b*, 94*c*, and 94*d* from their corresponding numeric cog 92*a*, 92*b*, 92*c*, 92*d*. Each numeric cog/cam pair is held together by a spring 84 at the opposing end of the axel, this spring makes each pair spin as one. The four pairs of numeric cogs and cams spin as a paired unit revolving together in a linked position independent of the other pairs. This paired position is held together by opposing gears that connect the inter portions of the cams and cogs, which act as a single unit held together by a spring 84. Within each cam/cog pair there is one flat section on the cam. This flat section corresponds to the correct number in the combination. To unlock the combination all the flat sections on the cams need to be aligned so the flat sections on the cams line up horizontally with the lock plate. If even one pair of numeric cog/cams is even 36 rotational degrees offset (one number off) then the system remains locked and the lock plate is still held up.

FIG. 7B is a side view of the housing. The side view shows how the dog cap of FIG. 4B is contained in the housing. In particular, the ledge 176 holds the dog cap in its position. The side wall 174 is slightly larger in diameter than the dog cap that fits inside of it; this allows the cap to spin within the housing. The dog cap is made with a more slick plastic to reduce friction with the housing.

The cap locking device described above and illustrated in the figures is a prevention device that may, for a prescription bottle, allow prescription holders not only to have a more secure medical container, but also to be raise awareness when someone is tampering with their prescriptions. The cap locking device is not a high security device because someone could still break or steal the bottle. The cap locking device is aimed at deterrence, removing the opportunity for teens to steal medications without the prescription holder's knowledge.

In addition to being used to lock a medical prescription bottle, there are many other uses for the cap locking device such as a cap and lock for expensive perfumes, vitamins, supplements, and hazardous materials or any bottle in which it is desirable to lock the bottle closed. The overall diameter of the cap locking device can be adjusted as needed to fit each type of bottle.

While the foregoing has been with reference to a particular embodiment of the invention, it will be appreciated by those skilled in the art that changes in this embodiment may be made without departing from the principles and spirit of the disclosure, the scope of which is defined by the appended claims.

I claim:

1. A cap lock attachable to a bottle, comprising:

a cap portion that has an upper surface with a plurality of first gaps in the upper surface;

a rotatable dial lock mounted in the cap portion, the rotatable dial lock having at least four cogs and cams in mechanical relationship with each other to allow the cogs to spin and wherein the cogs are settable to a plurality of combinations;

a dog plate, mounted to the cap portion that freely rotates within the cap portion, the dog plate having one or more teeth that allow sufficient torque to be exerted to rotate the cap when the lock is open;

a locking plate, above the rotatable dial lock, having a plurality of second gaps and pivotally mounted to the cap portion, the locking plate being movable between a locked position and an unlocked position and wherein the plurality of second gaps are in alignment with said plurality of first gaps whereby the cogs are held in place by the plurality of first gaps and the plurality of second gaps; and the locking plate being placed in the unlocked position when said cogs are set to a predetermined one of said plurality of settings, and said locking plate being placed in said locked position when said cogs are set to one of said plurality of settings other than said predetermined setting, the locking plate having a reset access by which the predetermined setting that places the locking plate in the unlocked position can be reset when the locking plate is in the unlocked position and an arm of the locking plate, when the locking plate is in the locked position, blocking the reset access so that the predetermined setting that places the locking plate in the unlocked position cannot be reset when the locking plate is in the locked position.

2. The cap lock of claim 1 further comprising a base portion that is permanently attached to said cap portion by an interlocking fit between the base portion and the cap portion.

3. The cap lock of claim 1, wherein the locking plate further comprises an extension of the locking plate that is disengaged from the one or more teeth of the dog plate when the locking plate is in the locked position and the housing cannot be rotated so that the cap lock cannot be removed from a bottle.

4. The cap lock of claim 2, wherein said interlocking fit is a snap fit.

5. The cap lock of claim 1, wherein each tooth of the dog plate has a bevel.

6. The cap lock of claim 1, wherein the locking plate is located above the cams.

7. The cap lock of claim 1, wherein the first gaps are positioned centrally in the upper surface.

8. The cap lock of claim 1, wherein each cam has a first surface and a second surface and the locking plate is in the unlocked position when the first surface of each cam is adjacent the locking plate.

9. The cap lock of claim 8, wherein the locking plate is above the rotatable dial lock and the first surface of each cam is a flat surface that allows the locking plate to move downwards and engage the one or more teeth of the dog plate.

10. The cap lock of claim 9, wherein the second surface of each cam is a round surface that holds the locking plate and disengages an extension of the locking plate from the one or more teeth of the dog plate.

* * * * *